US010926259B2

(12) United States Patent
Egeland

(10) Patent No.: US 10,926,259 B2
(45) Date of Patent: Feb. 23, 2021

(54) FLUID FILTERING DEVICE AND ASSEMBLY

(71) Applicant: Trilobite Innovation AS, Kristiansand (NO)

(72) Inventor: Eirik Bentzen Egeland, Kristiansand (NO)

(73) Assignee: Trilobte Innovation AS, Kristiansand (NO)

( * ) Notice: Subject to any disclaimer, the term of this patent is extended or adjusted under 35 U.S.C. 154(b) by 0 days.

(21) Appl. No.: 15/031,288

(22) PCT Filed: Oct. 24, 2014

(86) PCT No.: PCT/EP2014/072823

§ 371 (c)(1),
(2) Date: Apr. 22, 2016

(87) PCT Pub. No.: WO2015/059264

PCT Pub. Date: Apr. 30, 2015

(65) Prior Publication Data

US 2016/0279636 A1 Sep. 29, 2016

(30) Foreign Application Priority Data

Oct. 25, 2013 (NO) ..... 20131411

(51) Int. Cl.
*B01L 99/00* (2010.01)
*B01L 3/00* (2006.01)

(52) U.S. Cl.
CPC ... *B01L 3/502753* (2013.01); *B01L 3/502715* (2013.01); *B01L 3/502746* (2013.01); *B01L 3/502761* (2013.01); *B01L 2200/0647* (2013.01); *B01L 2300/0681* (2013.01); *B01L 2300/08* (2013.01); *B01L 2300/0861* (2013.01); *B01L 2400/084* (2013.01)

(58) Field of Classification Search
None
See application file for complete search history.

(56) References Cited

U.S. PATENT DOCUMENTS

2006/0266692 A1 11/2006 Foster

FOREIGN PATENT DOCUMENTS

| | | | |
|---|---|---|---|
| EP | 0231432 | A2 | 8/1987 |
| EP | 1457251 | A1 | 9/2004 |
| FR | 2576805 | Y | 8/1986 |
| GB | 2472506 | Y | 2/2011 |
| WO | WO2006/127256 | A | 11/2006 |

OTHER PUBLICATIONS

Virginia VanDelinder et al: Separation of Plasma from Whole Human Blood in a Continuous Cross-Flow in a Molded Microfluidic Device.
Norwegian Seach report of 2115-11-13, cited inter alia as statement of relevance for non-english references cited therein.

*Primary Examiner* — Paul S Hyun
(74) *Attorney, Agent, or Firm* — Christian D. Abel

(57) ABSTRACT

A fluid refining device and assembly comprises an inlet for fluid to be refined, a separation outlet and a concentration outlet for processed fluid in a refining layer, wherein the refining layer comprises a plurality of refining units arranged in a pattern, and wherein the cross section of the concentration outlet is less than the cross section of the inlet.

4 Claims, 5 Drawing Sheets

FLUID FILTERING DEVICE AND ASSEMBLY

FIELD OF THE INVENTION

The present invention relates to a fluid refining assembly, in particular to a device which is compatible with microfabrication technologies, and can be applied in the fields of microfluidics and other related technologies, as well as being able to operate with larger volumes.

BACKGROUND

The field of microfluidics is concerned with the behaviour, control and manipulation of fluids that are geometrically constrained to a small, typically sub-millimetre, dimension, and more typically with volumes of fluid in the millilitre scale, microlitre scale, nanolitre scale or even smaller. Common processing manipulations that one may wish to apply to fluids at all scales include concentrating, separating, mixing and reaction processes.

Over the last few decades miniaturisation technologies have progressed which, in the chemical and biotechnology fields in particular, has resulted in the emergence of lab-on-a-chip devices which are now in common use. For example, micro-chemical devices and microelectromechanical systems (MEMS) such as bio-MEMS devices are known.

However, it is not always feasible to directly miniaturize conventional fluid processing systems designed for relatively large volumes of fluids for use in the microfluidic field where the system would be typically provided on a chip as a lab-on-a-chip device. Take the centrifugation process as an example: the centrifugation process involves a circular plate and comprises complex mechanical and electrical systems, which are only readily applicable for processing relatively large volumes of fluids in at least several tens of milliliter scale. For microfluidics where the volumes of fluid are typically in the micro- or nano-litre scale, such a device would be uneconomical. It would also be extremely difficult from a physical engineering perspective to miniaturize the conventional centrifugation systems on to a chip scale device directly.

The concentration and separation of samples are indispensable for clinical assay and biomedical analysis. The demand for cell fractionating and isolating for such applications has increased for molecular diagnosis, cancer therapy, and biotechnology applications within the last two decades. Consequently, alternative systems for concentration/separation of small/micro volumes of fluids, which involve different mechanisms, have been developed. Among these systems, some utilize the mechanical principles, such as force, geometry, etc.; and others utilize multi physics coupling method, such as magnetic field, electric field, optics, etc.

For concentration purpose, by utilizing differences in cell size, shape and density, various membrane structures microconcentrators have been developed, such as ultrafiltration membranes or nanoporous membranes formed by using ion track-etching technology for separating fluid components. See for example, R. V. Levy, M. W. Jornitz. Types of Filtration. Adv. Biochem. Engin./Biotechnol., vol. 98, 2006, pp. 1-26, and S Metz, C Trautmann, A Bertsch and Ph Renaud. Polyimide microfluidic devices with integrated nanoporous filtration areas manufactured by micromachining and ion track technology. Journal of Micromechanics and Microengineering, 2004, 14: 8. Even more, a MEMS filter modules with multiple films (membranes) has been invented, see: Rodgers et al, MEMS Filter Module, US 2005/0184003A1.

However, due to the presence of "dead-ends" in such membranes (films), clogging is common for microfilters with such flat membrane structures and would be even much more severe in those with multiple films. Moreover, microfilters with flat membrane structures require specialised fabrication processes, which results in difficulties in integrating such thin functional membranes into a lab-on-chip system.

To eliminate the dead-ends in membrane filters, the so-called "cross-flow" filters were developed, see for examples: Foster et al., Microfabricated cross flow filter and method of manufacture, US2006/0266692A1 and Iida et al., Separating device, analysis system, separation method and method for manufacture of separating device, EP1457251A1. In their inventions, the filtrate barriers are often made with arbitrary shapes, with simple geometrical profiles, i.e., square, trapezoid, and even crescent. These non-streamline profiles of the barriers will cause extra flow resistance, which reduces the filtrate efficiency. Moreover, due to the presence of square corners or cusps in such arbitrary geometrical profiles, clogging is apt to occur in practical use since the target cells or particles may have considerable deformability and adhesiveness.

FR 2576805 regards a filtrating apparatus which comprises at least one filtration module and where each filtration module comprises a filtration material. The filtration material is for example a porous membrane from natural or synthetic textile materials or metal or any suitable textile fiber, felt, etc. Such filtration materials will be easily clogged by any contaminations and particles in the fluid which is filtrated. There is a need for a fluid refining assembly which improves prior art in for example having the following features:

Less pressure loss,

Non-clogging,

Highly scalable

In the context of this description, the term "refining" will mean all types of fluid processing, such as sorting, separation, concentration, or filtration of fluids comprising particles, multi phase fluids, or other fluids.

Object of Invention

The object of the invention is to provide a fluid refining assembly which improves the fluid flow and balances the pressure and volume flow through the assembly.

The object of the invention is achieved by means of the features of the claims.

In one embodiment, a fluid refining device comprises an inlet for fluid to be refined, a separation outlet and a concentration outlet for processed fluid in a refining layer, wherein the refining layer comprises a plurality of refining units arranged in a pattern, and wherein the cross section of the refining layer at the concentration outlet is less than the cross section at the inlet.

The distance between the Trilobite units inside the system will always be significant larger than the largest incoming particle. This means that the first device that the complex liquid meets is the complete opposite of a typical membrane filter. In a typical membrane filter the particles within a complex liquid will encounter a pore that is significantly smaller than the largest particle in the liquid, and that will hinder the fluid flow to a great extent. In the Trilobite system, the flow is not hindered and thus the pressure loss will be reduced.

In one embodiment of the invention the decrease in cross-sectional area is proportional to the volume of fluid flowing through the separation outlet. In this way the fluid flow and pressure balance is improved over prior art.

The refining units may be arranged with a distance between each other according to the relationship between particles sizes and the channel size in order to further enhance the flow characteristics and particle separation.

The refining units may be arranged with a distance between them according to the velocity profile of the fluid to be processed in order to avoid a recirculation region downstream of the refining units. With a large distance between the refining units and a large flow of fluid, there may be produced bubbles which can capture particles thus causing the particles to take a different path than intended, thus decreasing the effectivity of the refining device. The distance between the refining units should be balanced with the flow velocity.

In one embodiment the refining units are distributed in a regular pattern over the refining layer. The pattern may be chosen among a number of different regular patterns, and are for example one layer of a hexagonal close packed pattern, cubic close packed pattern, random close packed, etc.

In a further embodiment, the refining layer is shaped as a symmetrical trapezoid (isosceles trapezoid) and the inlet is arranged at the broad base of the trapezoid and the concentration outlet is arranged at the short base of the trapezoid. The complete layer defining the refining layer may have the desired shape, or the outline of the pattern of refining units in the refining layer has the desired shape, for example being shaped as a symmetrical trapezoid (isosceles trapezoid). In the latter case, the inlet and the concentration outlet may be defined within or at the outline of the pattern of refining units.

The object of the invention is also achieved by means of a fluid refining assembly comprising an inlet for fluid to be refined, at least a separation outlet and a concentration outlet for refined fluid, a refining layer, a collecting layer and a cover layer, where the refining layer comprises a plurality of refining units arranged in a pattern, wherein the outline of the pattern is shaped as a symmetrical trapezoid (isosceles trapezoid) and where the inlet is arranged at the broad base of the trapezoid and at least one outlet is arranged at the short base of the trapezoid.

The fluid flow out of the concentration outlet is constructed to be reduced into a minimum amount of flow in order to maximize the concentration of the particles that the Trilobite system is constructed to concentrate. This concentration is happening in a 360 degree expose to maximize the highest possible flow. This system is separating out the biggest particles first without causing any direct disturbance to the flow direction or towards the particles.

A fluid refining unit for use in a fluid refining device as described above, may in one embodiment comprise one output flow channel; one blunt nose section facing in an upstream direction towards an incoming fluid; one barrier section facing in a downstream direction; the barrier section comprising a series of barrier elements and interposed gaps; the barrier elements having a turbine blade-like shape based on streamline design and the interposed gaps defining barrier channels providing fluid communication between an input flow channel and the output flow channel; barrier flow occurring wherein the angle between the barrier flow and a main flow is greater than 90 degrees.

The invention will now be described in more detail, by reference to the accompanying figures.

Figures 5A, 5B:
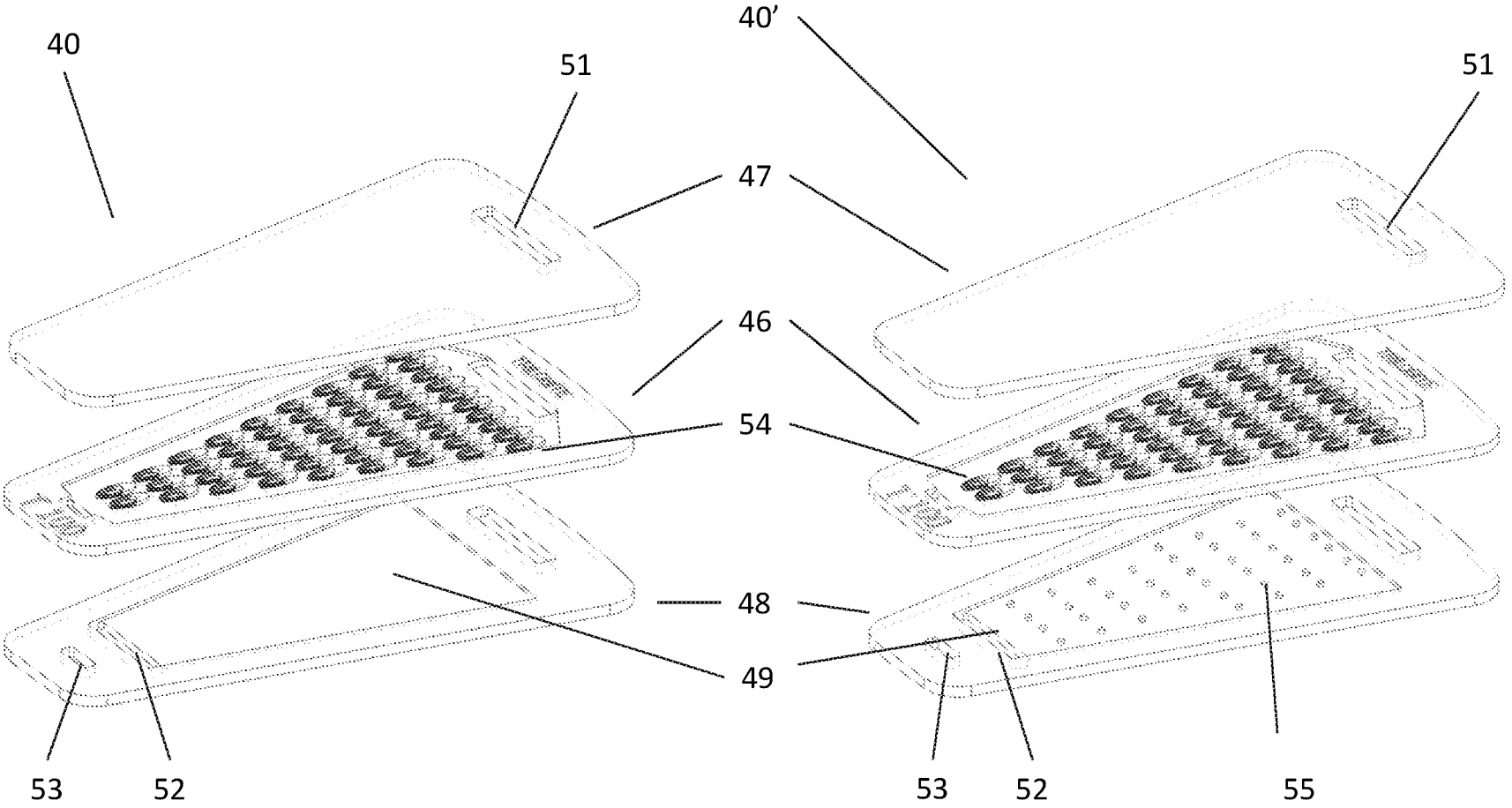

FIGS. 5*a* and *b* illustrates schematically examples of a fluid refining assembly.

Figure 1:
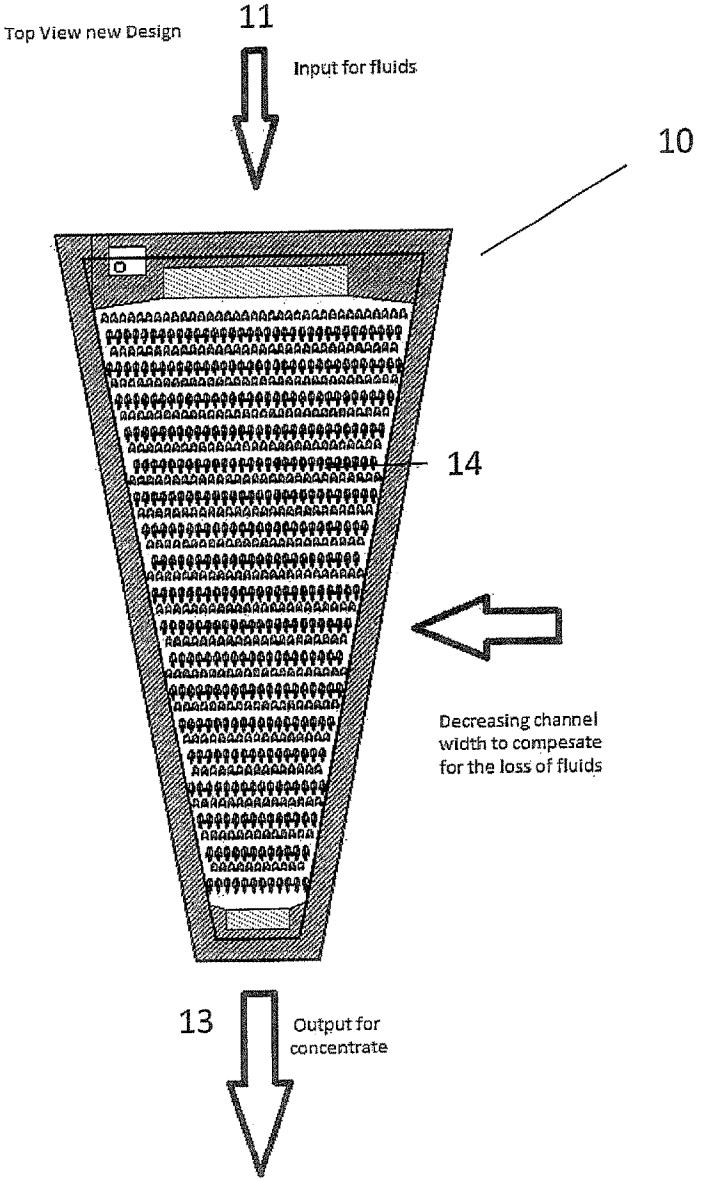
FIG. 1 illustrates an example of a refining layer of a fluid refining device.

The refining layer 10 illustrated in FIG. 1 is designed as a part of a fluid refining device which comprises an inlet 11 for fluid to be refined, a separation outlet (not shown) and a concentration outlet 13 for processed fluid. The refining layer 10 further comprises a plurality of refining units 14 arranged in a pattern. The cross section of the refining layer is in this embodiment shaped as a symmetrical trapezoid (isosceles trapezoid), where the inlet is arranged at the broad base of the trapezoid and the concentration outlet is arranged at the short base of the trapezoid. The cross section at the concentration outlet is thus less than the cross section at the inlet. In this example, the refining layer and the outline of the pattern of refining units 14 has the same shape, but as described above, the shapes may differ. For example could the refining layer 10 have a rectangular shape, while the shape of the outline of the pattern of the refining units 14 could be a trapezoid.

Fluid flows into the inlet 11 and flows along the refining layer 10. During the flow along the refining layer 10, the fluid passes the refining units 14, where a refining process takes place. As the flow passes each of the refining units 14, small particles, ie. with sizes smaller than the characteristic refining size of the refining units, will be trapped/captured by the refining units 14, from where some of the flow and the small particles will be let out through the separation outlet. The remaining fluid and particles exits the refining layer 10 and the fluid refining device through the concentration outlet 13. The separation outlet is designed to allow as large amount as possible of fluid flow to exit in order to maximize the concentration of the particles that the fluid refining device can concentrate. The amount of fluid exiting the concentration outlet 13 should however be large enough to allow the fluid flow to be mainly constant over the refining layer 10. This is facilitated by the reduction in cross section over the area of the refining layer 10. This system is thus separating out the biggest particles first without causing any direct disturbance to the flow direction or towards the particles.

Figure 2:
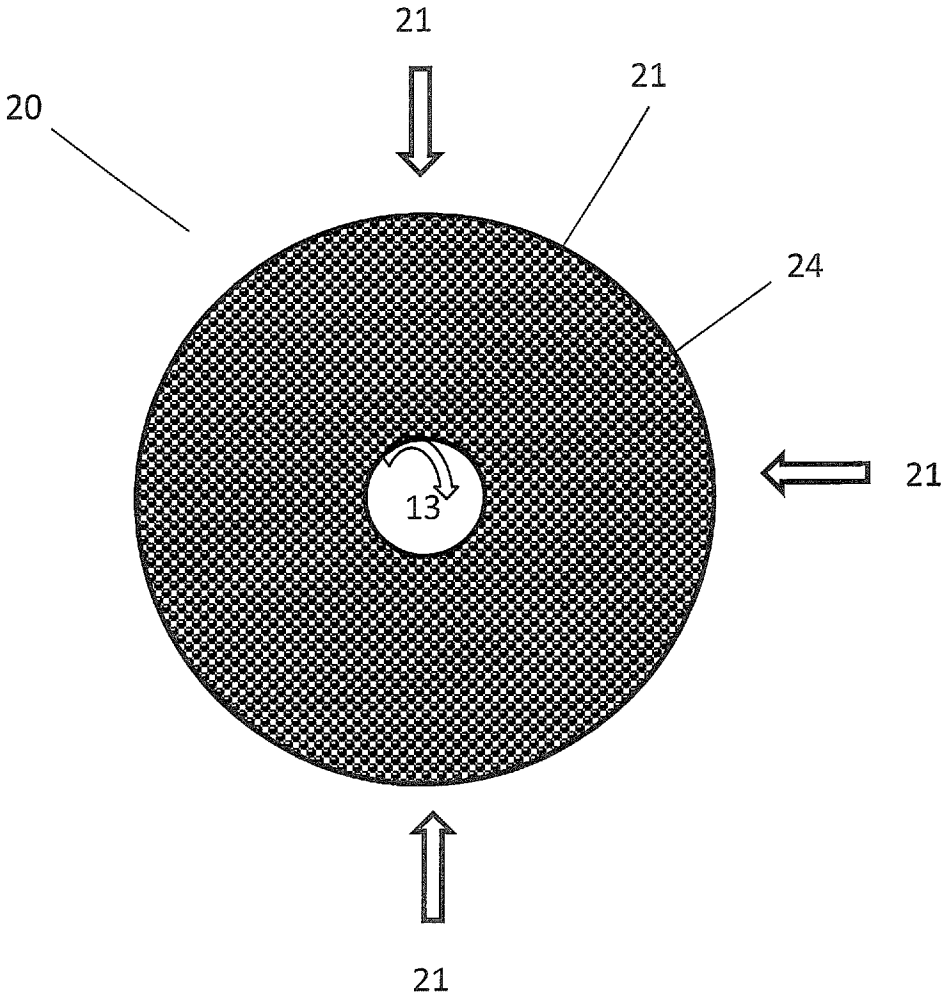
FIG. 2 shows another example of a refining layer.

FIG. 2 shows another example of a refining layer 20. In this embodiment the refining layer 20 is shaped as a doughnut, having a circular outer circumference and a circular opening in the center. The inlet 11 is arranged along the circumference of the outer circumference, the concentration outlet 13 is arranged at the circular opening in the center. Also in this embodiment the cross section at the concentration outlet 21 is thus less than the cross section at the inlet 13.

Figure 3:
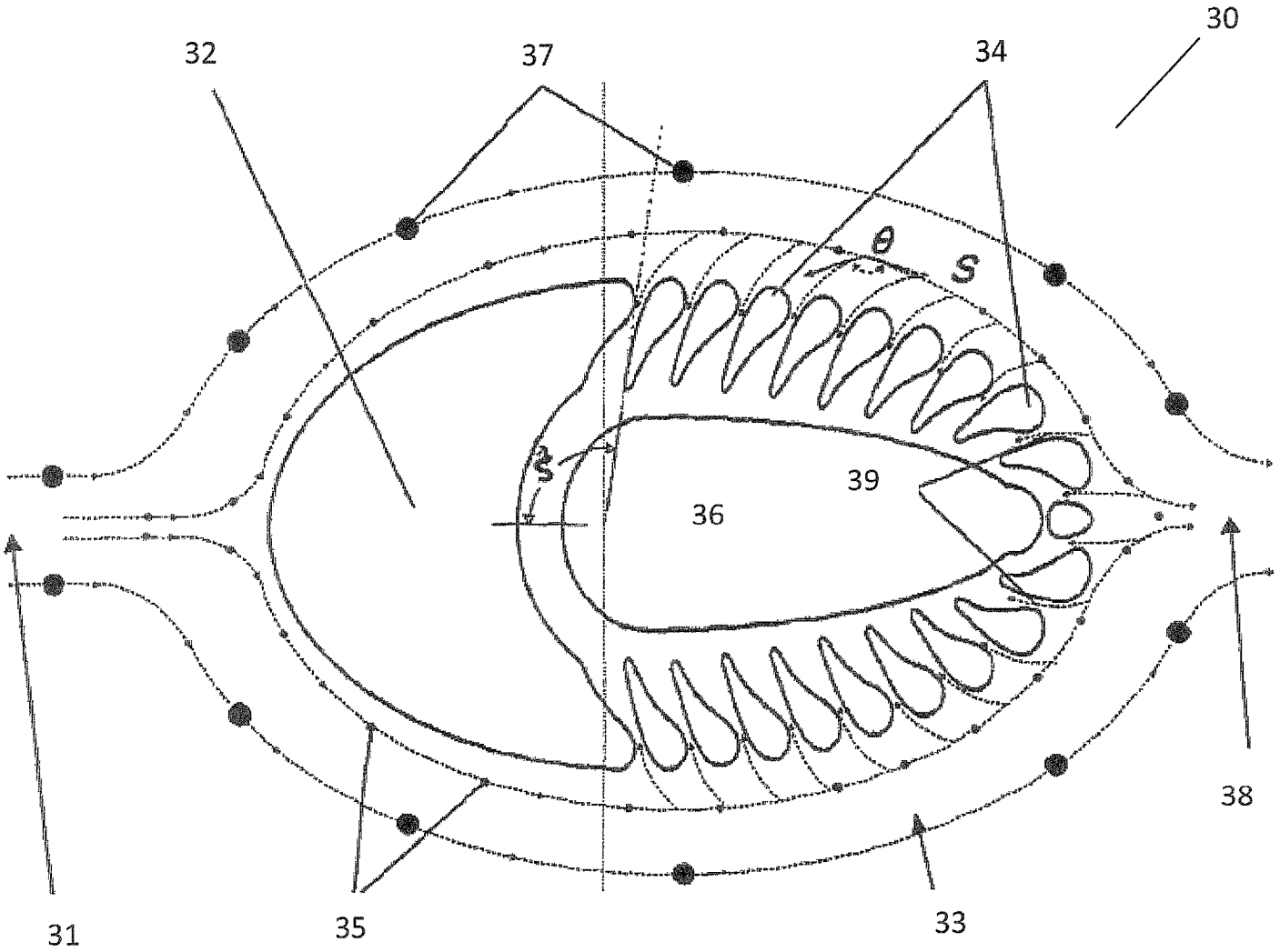
FIG. 3 illustrates schematically an example of a refining unit for use in a fluid refining device.

FIG. 3 illustrates schematically an example of a refining unit 30 for use in a fluid refining layer and device. The refining unit 30 utilizes a combination of two separation techniques, centrifugal force and cross-flow dead-end filtration.

As shown the refining unit 30 comprises an inlet flow 31 that a fluid to be processed enters, a nose section 32, barrier elements 34, an outlet flow channel 36 and concentrated flow 38.

The nose section 32 is a solid section forming the upstream half of the refining unit facing the inlet flow 31 and a porous barrier section 33 formed from a plurality of the turbine blade-like barrier elements or vanes 34 with interposed barrier channels 39. It should be noted that the barrier elements 34 in this device are preferably to take a turbine blade-like shape, though other smoothed shapes such as circle, elliptic, etc. are also applicable. Preferably the barrier section 33 extends through an angle of approximately 180 degrees, from =90 degrees to =270 degrees as viewed in FIG. 3.

The overall refining unit is in the shape of near elliptical cylinder with its long axis aligned with the flow of fluid entering through the inlet 31. Thus, the nose section 32 of the refining unit 30 initially presents a blunt body facing the coming flow which causes the flow to bifurcate and pass on both sides of the barrier. It should be noted that the blunt body can be any cylindroids, either cylinder or elliptical cylinder.

All the streamlined barrier elements 34 are located internally tangent to the ellipse of the refining unit.

Barrier channel flow occurs in the interposed gaps 39 sandwiched by adjacent elements 34, with the direction of flow in the channels 39 being at an obtuse angle, counter to the normal direction of the elliptic cylinder at the entrance to each respective barrier channel. As with the channels described above, the angle between the flow around the refining unit and within the channels is preferably at an angle of at least 90 degree. And the obtuse angle can be measured according to the angle included by the velocity vectors of the main flow and the penetrate flow, marked as 8 in FIG. 4.

The filtrate gathers to the centre of the device 30 and exits through outlet flow channel hole 36 where it may then be passed to, for example, a collection layer as described below.

For low Reynolds number flow, given a uniform velocity u0 of the inflow, the local velocity distribution around the ellipse shaped refining unit can be described according to the potential flow theory (see I. G. Currie. Fundamental mechanics of fluids, 2nd Ed., McGraw-Hill: New York, 1993.), that is: −u0(1+b/a)sin sin 2+(b/a) cos 2 where the parameters a, b, are the major and minor axes of the barrier, respectively, defined as the angle of local position relative to the inflow. It is noticed that the angle is greater than 90 degree.

A consequence of the centrifugal forces experienced by the flow due to the elliptical cylindrical shape of the refining unit 30 is that high velocity particles usually have trajectories further away from the refining unit than low velocity particles. The particle velocity is dictated by the velocity of the carrier fluid surrounding the particle. In turn, the local fluid velocity around a particle is strongly coupled to the flow rate of feed fluid. Therefore, the probability for a particle to remain in the main flow increases with increasing flow rate of feed fluid. Small particles, even particles smaller than the gap between the obstacles, might remain in the main flow at high fluid velocities due to the centrifugal force.

As the inflowing fluid containing a solid component, such as for example blood cells, passes around the refining unit 32, 33, the bigger cells with higher mass 37 thus tend to be forced away from the entrances to the barrier channels 39 due to these effects and tend to pass on to the residue outlet 38. In contrast, the smaller cells with lower mass 35 can remain nearer the surface of the refining unit and the entrances to the barrier channels and are thereby enabled to be forced through the channels 39 between the elements 34.

Due to the obtuse angle of the channels 39 to the fluid flow around the barrier 33, the flow through the channels 39 is a contraflow which comprises an upstream element to the main flow direction around the barrier 33. It should be noticed the contraflow is caused by the geometrical design of the refining unit, not by the fluid flow itself.

To prevent clogging, the barrier elements 34 are convergent divergent in shape with respect to the direction of the penetrating flow. This creates an opposing pressure gradient which pushes the particles away from the small particle entrance region.

To minimize the production of vortices and low velocity regions, both of which would reduce the separation efficiency, the refining unit has a streamlined shape. The nose section 32 is shaped to maximize flow velocity in the direction of the barrier channels 39.

From this description, it will be clear that the size of the units, such as the unit 30 in FIG. 3, in the refining layer, for example as shown in FIGS. 1 and/or 2, the distance between them, the size of the vanes and the particle size to be separated out is related. The distance between the units relates to the particles size, and the unit size, vane size and gap between the vanes are closely related and can be chosen according to the use of the refining device.

Figure 4:
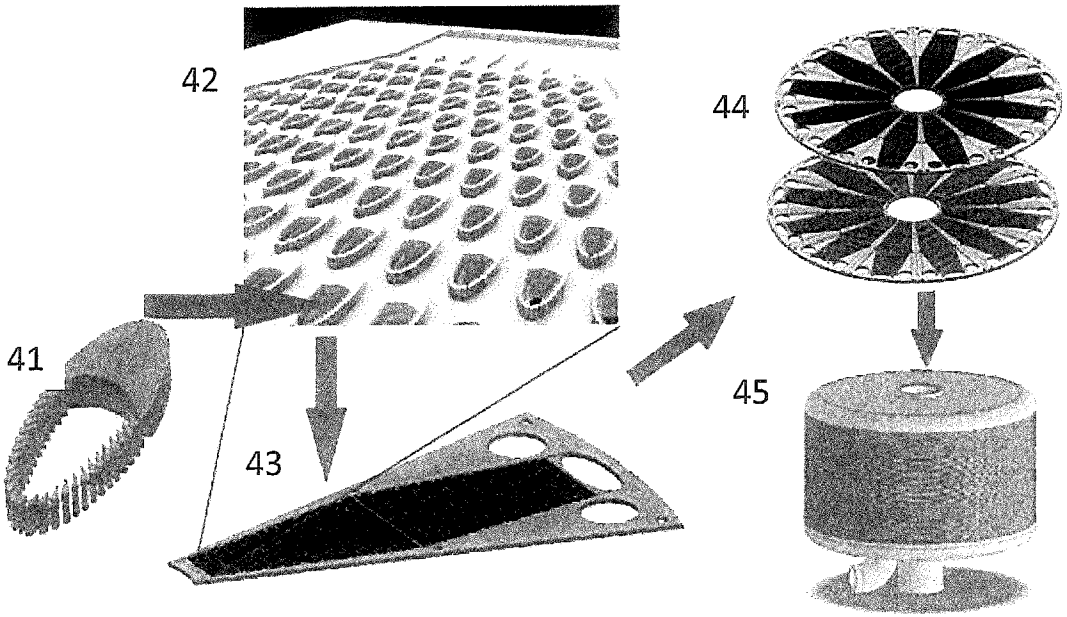
FIG. 4 illustrates an example of the elements of a refining assembly in which the refining layer and refining unit of the invention is used.

FIG. 4 illustrates an example of the elements of a refining assembly in which the refining layer and refining unit of the invention is used.

A number of refining units 41 are arranged in a refining layer 42. The shape of the refining layer may be a trapezoid as described in FIG. 1, or other suitable shape. In this figure the refining layer comprises a number of trapezoid shaped refining layers assembled into sector sections 43. A number of sector sections 43 are assembled to circular plates and arranged in a layered structure 44 constituting a cylindrical fluid refining assembly 45. Two refining devices arranged together will give one input and 3 outputs. One can separate and sort three different particle sizes using two refining devices, and by adding more devices, more particles/substances can be sorted out.

With one device the system will give two outputs, thus refining to a small degree the incoming fluid. One gets to separate between two sizes of particles. Or, one could also look at it as refining a fluid and make it more pure by removing some of the particles above a certain size.

FIGS. 5*a* and *b* illustrates schematically two examples of a fluid refining assembly 40, 40'. The two fluid refining assemblies are very similar, and similar components have the same reference numbers. The fluid refining assemblies 40, 40' comprise each an inlet 41 for fluid to be refined, a separation outlet 42 and a concentration outlet 43 for refined fluid. The assembly 40 is comprised of a refining layer 46, a collecting layer 48 and a cover layer 47. The refining layer 46 comprises a plurality of refining units 44 arranged in a pattern, wherein the outline of this pattern is shaped as a symmetrical trapezoid (isosceles trapezoid). In this example, also the fluid refining assembly and all three layers are shaped as a symmetrical trapezoid, and the outline of the pattern of the refining units is arranged inside the refining layer, having a circumference smaller than the circumference of the refining layer. As can be seen in the figures the inlet 41 is arranged at or near the broad base of the trapezoid and an outlet is arranged at or near the short base of the trapezoid.

In use, the fluid to be refined flows into the inlet 41 and flows along the refining layer 46. As the fluid flows along the refining layer 46, the fluid passes the refining units 44, where a refining process takes place, as described above. As the flow reaches each of the refining units 44, small particles, ie. with sizes smaller than the characteristic refining size of the refining units, will pass into the interior of the refining units, where there is a passage for allowing the fluid to flow into the collecting layer 48. The collecting layer 48 comprises a collecting space 49 for receiving the fluid from the refining units 44. In this embodiment, the collecting space 49 is formed as a recess in the collecting layer, having a shape and size which corresponds to the shape and size of the outline of the pattern of refining units in the reining layer 46. The fluid will then flow along the collecting layer 48, towards and through the separation outlet 42. The remaining fluid and particles not having flowed through the refining units 44, will exit the refining layer 10 and the fluid refining device through the concentration outlet 43. As described in connection with FIG. 1, the separation outlet is designed to allow as large amount as possible of fluid flow to exit in order to maximize the concentration of the particles that the fluid refining device can concentrate, while maintaining a generally constant fluid flow over the length of the refining layer 46.

The refining assembly of FIG. 5*b* has additionally a number of support elements 45 arranged in the collecting space of the collecting layer 48 and having a height corresponding to the depth of the collecting space. The support elements 45 may be in form of pillars, columns, or other elements suitable for maintaining a uniform spacing between the collecting layer 48 and the refining layer 46.

The invention claimed is:

1. Fluid refining device comprising a refining layer, the refining layer having an inlet opening for fluid to be refined and a concentration outlet for processed fluid, wherein the refining layer comprises a plurality of elliptical refining units arranged in a regular pattern over the refining layer with their long axis aligned with the fluid flow, and where the refining units each comprise an output flow channel, and where the output flow channels are connected to a separation outlet, and where there is a reduction in cross section over the entirety of the refining layer, and where the entire refining layer or the outline of the pattern of refining units in the refining layer is shaped as a single symmetrical trapezoid (isosceles trapezoid), where the inlet opening is arranged at the broad base of the trapezoid and the concentration outlet is arranged at the short base of the trapezoid, and the cross section of the concentration outlet is less than the cross section of the inlet opening and adapted to allow the fluid flow to be mainly constant over the refining layer.

2. Fluid refining device according to claim 1, wherein the reduction in cross-sectional area over the area of the refining layer adapted to the volume of fluid allowed to exit the separation outlet by the design of the separation outlet.

3. Fluid refining assembly comprising an inlet opening for fluid to be refined, at least a separation outlet and a concentration outlet for refined fluid, a refining layer, a collecting layer and a cover layer, where the refining layer comprises a plurality of elliptical refining units arranged in a regular pattern over the refining layer with their long axis aligned with the fluid flow, where the refining units each comprise an output flow channel, and where the output flow channels are connected to the separation outlet, and where there is a reduction in cross section over the entirety of the refining layer and where the entire outline of the pattern of refining units in the refining layer is shaped as a single symmetrical trapezoid (isosceles trapezoid), where the inlet opening is arranged at the broad base of the trapezoid and the concentration outlet is arranged at the short base of the trapezoid, and the cross section of the concentration outlet is less than the cross section of the inlet opening and adapted to allow the fluid flow to be mainly constant over the refining layer.

4. A fluid refining device/assembly according to one of claim 1 or 3, wherein each refining unit comprises one blunt nose section facing the inlet opening towards an incoming fluid, and one barrier section facing the concentration outlet; the barrier section comprising a series of barrier elements and interposed gaps; the barrier elements having a turbine blade-like shape or other smoothed shape and the interposed gaps defining barrier channels providing fluid communication between the inlet opening and the output flow channel.

* * * * *